US010894654B2

(12) United States Patent
Zhuang

(10) Patent No.: US 10,894,654 B2
(45) Date of Patent: Jan. 19, 2021

(54) AIRTIGHT THERMAL INSULATION PACKAGE WITH A LARGE OPENING THEREIN

(71) Applicant: Qiujing Zhuang, Fujian (CN)

(72) Inventor: Qiujing Zhuang, Fujian (CN)

(73) Assignee: Huian Huicheng Handbag Co., Ltd., Fujian (CN)

( * ) Notice: Subject to any disclaimer, the term of this patent is extended or adjusted under 35 U.S.C. 154(b) by 267 days.

(21) Appl. No.: 16/188,321

(22) Filed: Nov. 13, 2018

(65) Prior Publication Data

US 2020/0095049 A1 Mar. 26, 2020

(30) Foreign Application Priority Data

Sep. 21, 2018 (CN) ..... 2018 2 1552464 U

(51) Int. Cl.
*B65D 81/38* (2006.01)
*B65D 25/28* (2006.01)

(52) U.S. Cl.
CPC ..... *B65D 81/3888* (2013.01); *B65D 25/2841* (2013.01)

(58) Field of Classification Search
CPC ..... B65D 81/3888; B65D 25/2841
See application file for complete search history.

(56) References Cited

U.S. PATENT DOCUMENTS 2,346,563 A * 4/1944 Doppelt ..... A45C 3/00 190/122
2,714,911 A * 8/1955 Fontana ..... A45C 3/00 383/33
3,159,253 A * 12/1964 Breault ..... A45C 3/00 190/119
4,506,769 A * 3/1985 Franco ..... A45C 3/00 16/DIG. 40
4,561,525 A * 12/1985 Shidner ..... A45C 3/00 190/106
5,005,679 A * 4/1991 Hjelle ..... A45C 3/00 150/106
5,873,504 A * 2/1999 Farmer ..... A45C 3/00 150/113
6,582,124 B2 * 6/2003 Mogil ..... A45C 7/0077 383/110
9,801,444 B2 * 10/2017 Watson ..... A45C 11/00
2011/0016911 A1 * 1/2011 Mosby ..... A45C 13/02 62/457.7
2015/0008242 A1 * 1/2015 Kpabar, Jr. ..... B67D 3/0061 222/183
2020/0172321 A1 * 6/2020 White ..... B65D 81/3888

* cited by examiner

*Primary Examiner* — Tri M Mai

(57) ABSTRACT

The invention discloses an airtight thermal insulation with a large opening therein, comprising a base, a tableware box, a thermal insulation body, a zipper enclosure, an iron wire frame and a strap, wherein the side of the base has the tableware box, the top thereof has the body; the side of the body has an outer pocket, the left and right sides thereof have a handle above the pocket, the interior thereof has the inner lining; two sides of the inner lining top have a zipper tail strap extendedly, the periphery thereof has the velcro; the body top edge has a zipper enclosure; two sides of the enclosure have a side patch top, the enclosure is internally embedded with the iron wire frame comprising left and right ones. The overall structure is simple, the sealing effect is good, the large opening effect is achieved and it has certain promotion value.

6 Claims, 3 Drawing Sheets

AIRTIGHT THERMAL INSULATION PACKAGE WITH A LARGE OPENING THEREIN

BACKGROUND OF THE INVENTION

1. Field of the Invention

The invention relates to the technical field of thermal insulation package, and in particular, to an airtight thermal insulation package with a large opening therein.

2. Description of the Related Art

The traditional food storage packages do not have the heating function. The thermal insulation package on the market is a package that can hold drinks or food and keep the temperature and freshness thereof, which adopts the hot-melt seamless bonding technology and has a long thermal insulation time. It is a special package with temporary thermal insulation effect, which can keep cold or warm. The package that can keep cold is generally called cold insulation package, which can be used as the mobile refrigerator to keep the freshness of iced drinks, fruits, breast milk, tea, seafood and other foods, and can also be used for the refrigerated transportation of medicines, vaccines and other products; thermal insulation is generally used for food and lunch heat preservation, and for the delivery of food of restaurant, etc. For example, it can be used for children to bring lunch to school, which not only makes them enjoy fresh or warm food at any time, but also ensures the food sanitary and healthy. At present, the common insulation package material on the market is the non-woven fabric plus aluminum film pearl cotton, which can provide good thermal insulation effect; the product can be folded for convenient carrying and the design is portable, light and fashionable. The food can be kept warm and fresh for a long time. It is easy to use and suitable for outdoor picnics and daily life, and is therefore largely used.

However, the function of traditional thermal insulation packages is single, and the opening therein is small, which is inconvenient for accessing the food container; therefore, it is easy to cause the dumping of food container during the process of accessing it, which causes the soup to leak inside the thermal insulation package body, and it is difficult to clean. In addition, for the prior thermal insulation package, the food container and tableware are placed inside the package body, which is not only inconvenient to access, but also causes bad eating sanitary habits. Therefore, there is a need for an airtight thermal insulation package with a large opening therein to improve the above problems.

SUMMARY OF THE INVENTION

The invention aims at providing an airtight thermal insulation package with a large opening therein, so as to solve the issues set forth in the background art described above To achieve the objective above, the invention provides the technical solutions as follows:

An airtight thermal insulation package with a large opening therein, comprising a base, a tableware box, a thermal insulation package body, a zipper enclosure, an iron wire frame and a strap, wherein the side of the base is provided with the tableware box, the top of the base is provided with the thermal insulation package body; the side of the thermal insulation package body is provided with an outer pocket, the left and right sides of the thermal insulation package body are provided with a handle above the outer pocket, the interior of the thermal insulation package body is provided with the inner lining; two sides of the top of the inner lining are extendedly provided with a zipper tail strap, the periphery of the inner lining is provided with the velcro; the top edge of the thermal insulation package body is provide with a zipper enclosure; two sides of the zipper enclosure are provided with a side patch top, the zipper enclosure is internally embedded with the iron wire frame; the iron wire frame comprises a left iron wire frame and a right iron wire frame; the front and rear sides of the thermal insulation package body are provided with a side tab; the lower part of two groups of the side tab is provided with a connection buckle, and the connection buckle is buckled with two groups of snap; two groups of snap are fixedly connected through the strap.

Preferably, the tableware box is provided with two groups in total, both of which are movably arranged at the two inner sides of the base, and the base surface center of the tableware box is provided with a handle.

Preferably, the top of the outer pocket is provided with a zipper.

Preferably, the left iron wire frame and the right iron wire frame are symmetrically arranged inside the zipper enclosure.

Preferably, the inner wall of the thermal insulation package body is provided with a bonding belt stuck with the velcro.

Preferably, the thermal insulation package body is a seamless airtight thermal insulation package made by hot pressing method with TPU material.

Compared with the prior technology, the invention has the advantageous effects that:

1. When the zipper of the zipper enclosure with the iron wire frame is opened, the left iron wire frame and the right iron wire frame in the package opening can be oppositely unfolded to the body of the thermal insulation package, and the effect of a large opening is achieved.

2. Through the manufacturing process of adopting zipper enclosure and side tab, two sides of the zipper edge of zipper enclosure extend out of the package body and fit on two sides of the side patch top, which achieves the purpose that the zipper is extended out of the package body to a large opening.

3. Through the process that the zipper patch of the inner lining extends out and fits on two sides of the zipper edge of zipper enclosure to be aligned with the side patch top, and two sides of the zipper tail are closed by hot pressing method to achieve the effect of sealing the zipper edge.

4. The provided tableware box offers the convenience that the food container and the tableware are placed respectively. At the same time, when two sets of tableware are needed, they can be placed respectively through two groups of tableware box, so that each of them has independent storage space, thereby to achieve the purpose of paying attention to the eating sanitary habits.

5. The overall structure of the device is simple and the sealing effect is good; the effect of a large opening is achieved and it has certain promotion value.

In the figures, 1 refers to the base, 2 refers to the tableware box, 3 refers to the thermal insulation package body, 4 refers to the outer pocket, 5 refers to the handle, 6 refers to the side tab, 7 refers to the connection buckle, 8 refers to the zipper enclosure, 9 refers to the side patch top, 91 refers to the zipper tail strap, 10 refers to the iron wire frame, 11 refers to the left iron wire frame, 12 refers to the right iron wire frame, 13 refers to the inner lining, 14 refers to the velcro, 15 refers to the snap, 16 refers to the strap.

PREFERRED EMBODIMENTS OF THE INVENTION

The technical solutions in the embodiments of the invention are clearly and completely described in the following with reference to the accompanying drawings in the embodiments of the invention. It is obvious that the described embodiments are only parts of the embodiments of the invention, not all of the embodiments. All other embodiments based on the embodiments of the invention made by those of ordinary skill in the art without creative efforts shall fall within the protection scope of the invention.

Figure 1:
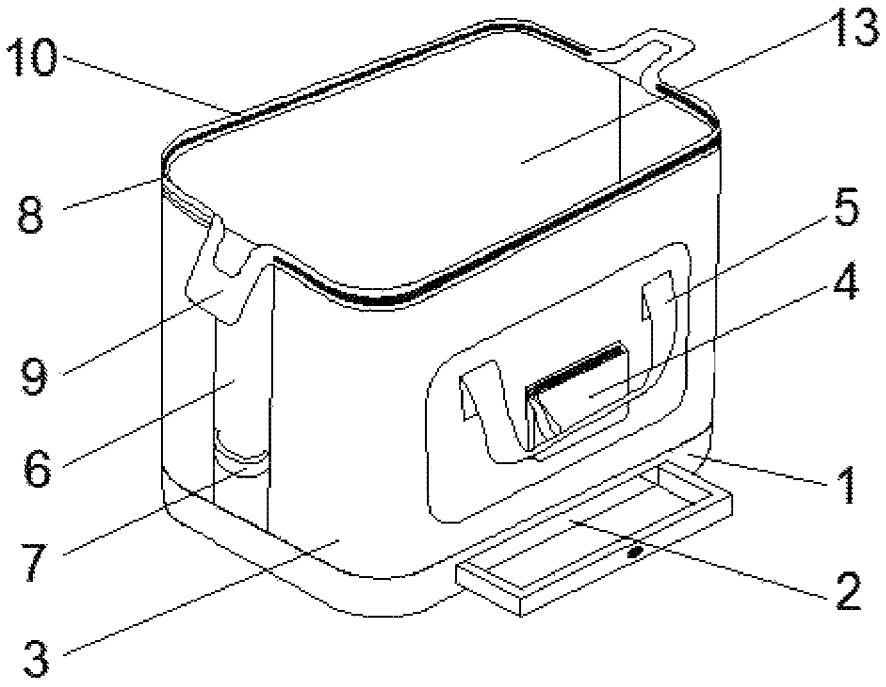
FIG. 1 is the schematic diagram illustrating the structure of the thermal insulation package of the invention when the package body is unfolded.
Figure 2:
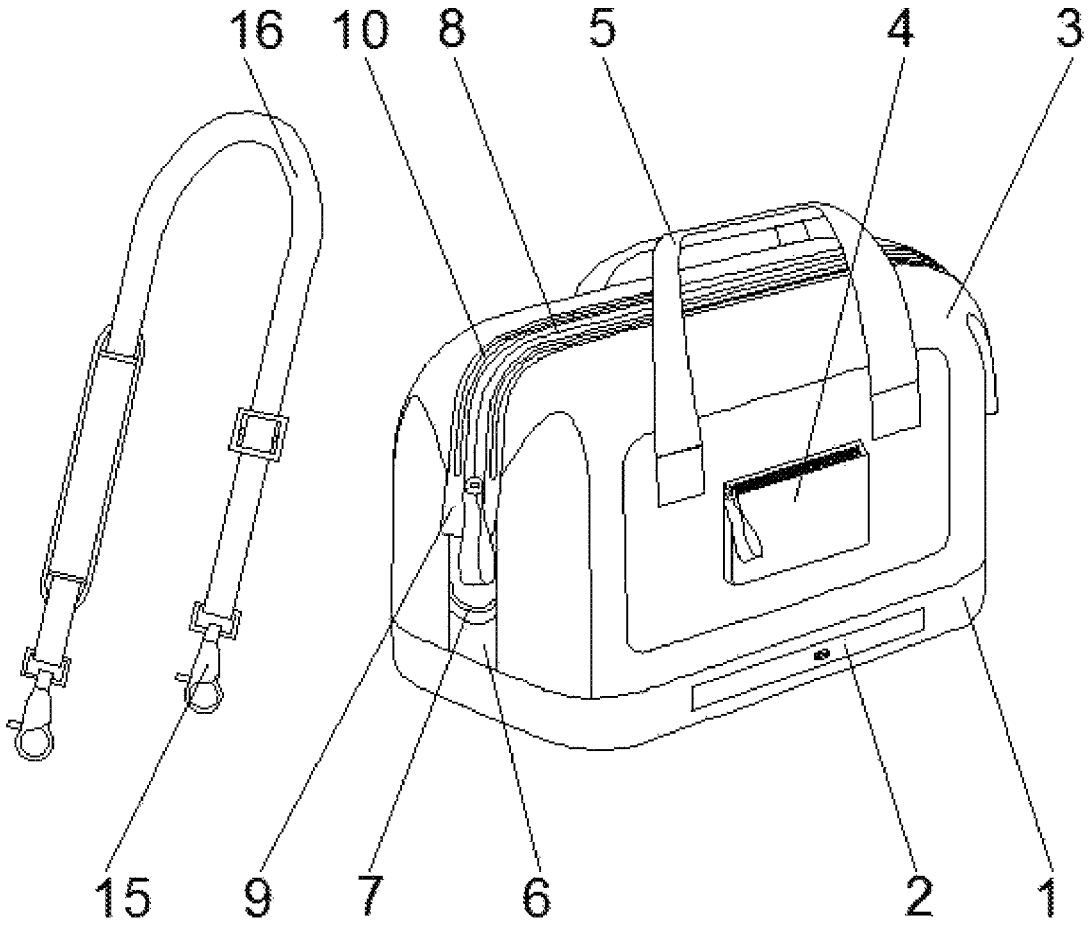
FIG. 2 is the schematic diagram illustrating the overall structure of the invention.
Figure 3:
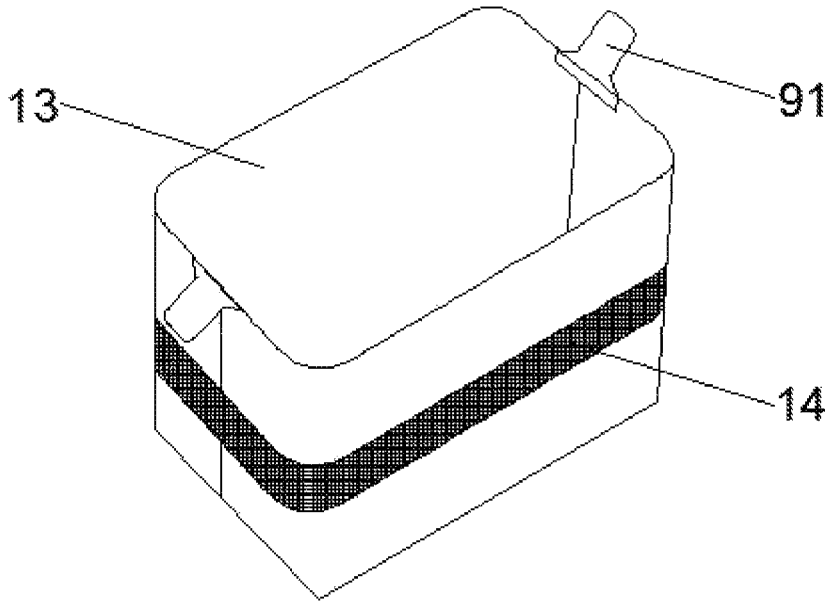
FIG. 3 is the schematic diagram illustrating the structure of the inner lining of the invention.
Figure 4:
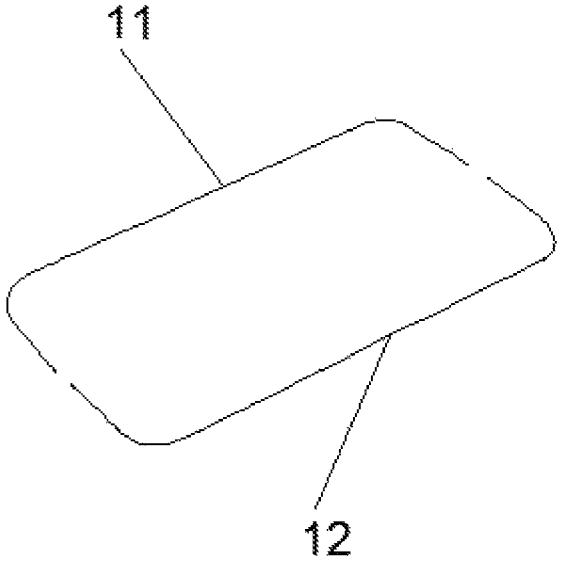
FIG. 4 is the schematic diagram illustrating the structure of the iron wire frame.

With reference to FIG. 1-4, the invention provides a technical solution:

An airtight thermal insulation package with a large opening therein, comprising a base 1, a tableware 2, a thermal insulation package body 3, a zipper enclosure 8, an iron wire frame 10 and a strap 16, wherein the side of the base 1 is provided with the tableware box 2 and the tableware box 2 is provided with two groups in total, both of which are movably arranged at the two inner sides of the base 1, and the base surface center of the tableware box 2 is provided with a handle. The provided tableware box 2 offers the convenience that the food container and the tableware are placed respectively. At the same time, when two sets of tableware are needed, they can be placed respectively through two groups of tableware box, so that each of them has independent storage space, thereby to achieve the purpose of paying attention to the eating sanitary habits. The top of the base 1 is provided with the thermal insulation package body 3, and the thermal insulation package body 3 is a seamless airtight thermal insulation package made by hot pressing method with TPU material. The side of the thermal insulation package body 3 is provided with an outer pocket 4, and the top of the outer pocket 4 is provided with a zipper. The left and right sides of the thermal insulation package body 3 are provided with a handle 5 above the outer pocket 4, the interior of the thermal insulation package body 3 is provided with the inner lining 13; two sides of the top of the inner lining 13 are extendedly provided with a zipper tail strap 91, the periphery of the inner lining 13 is provided with the velcro 14, and the inner wall of the thermal insulation package body 3 is provided with a bonding belt stuck with the velcro 14. The top edge of the thermal insulation package body 3 is provide with a zipper enclosure 8, and two sides of the zipper enclosure 8 are provided with a side patch top 9. Through the manufacturing process of adopting zipper enclosure 8 and side tab 6, two sides of the zipper edge of zipper enclosure 8 extend out of the package body and fit on two sides of the side patch top 9, which achieves the purpose that the zipper is extended out of the package body to a large opening. The zipper enclosure 8 is internally embedded with the iron wire frame 10; the iron wire frame 10 comprises a left iron wire frame 11 and a right iron wire frame 12, and the left iron wire frame 11 and the right iron wire frame 12 are symmetrically arranged inside the zipper enclosure 8. The front and rear sides of the thermal insulation package body 3 are provided with a side tab 6. Through the process that the zipper patch of the inner lining 13 extends out and fits on two sides of the zipper edge of zipper enclosure 8 to be aligned with the side patch top 9, and two sides of the zipper tail are closed by hot pressing method to achieve the effect of sealing the zipper edge. When the zipper of the zipper enclosure 8 with the iron wire frame 10 is opened, the left iron wire frame 11 and the right iron wire frame 12 in the package opening can be oppositely unfolded to the body 3 of the thermal insulation package, and the effect of a large opening is achieved. The lower part of two groups of the side tab 6 is provided with a connection buckle 7, and the connection buckle 7 is buckled with two groups of snap 15; two groups of snap 15 are fixedly connected through the strap. The overall structure of the device is simple and the sealing effect is good; the effect of a large opening is achieved and it has certain promotion value.

Workflow of the invention: Before the usage, through the manufacturing process of adopting zipper enclosure 8 and the side tab 6, two sides of the zipper edge of zipper enclosure 8 extend out of the package body and fit on two sides of the side patch top 9, which achieves the purpose that the zipper is extended out of the package body to a large opening. At the same time, through the process that the zipper patch of the inner lining 13 extends out and fits on two sides of the zipper edge of zipper enclosure 8 to be aligned with the side patch top 9, and two sides of the zipper tail are closed by hot pressing method to achieve the effect of sealing the zipper edge. When in usage, the left iron wire frame 11 and the right iron wire frame 12 in the package opening can be oppositely unfolded to the body 3 of the thermal insulation package, and the effect of a large opening is achieved. Then placing the prepared food container inside the thermal insulation body 3; at the same time, when two sets of tableware are needed, they can be placed respectively through two groups of tableware box 2, so that each of them has independent storage space, thereby to achieve the purpose of paying attention to the eating sanitary habits. At last, the prepared thermal insulation package is connected to the connection buckle 7 on two sides of the side tab 6 through the snap 15 on two sides of the strap 16, and then the entire device can be carried. The overall structure of the device is simple and the sealing effect is good; the effect of a large opening is achieved and it has certain promotion value.

Although embodiments of the invention have been illustrated and described, it is understood that those of ordinary skill in the art may make various changes, modifications, alternatives and transformations on these embodiments without departing from the principles and spirit of the invention. The protection scope of the invention is defined by the appended claims and the equivalents thereof.

The invention claimed is:

1. An airtight thermal insulation package with a large opening therein, comprising a base (1), a tableware box (2), a thermal insulation package body (3), a zipper enclosure (8), an iron wire frame (10) and a strap (16), wherein the side of the base (1) is provided with the tableware box (2), the top of the base (1) is provided with the thermal insulation package body (3); the side of the thermal insulation package body (3) is provided with an outer pocket (4), the left and right sides of the thermal insulation package body (3) are provided with a handle (5) above the outer pocket (4), the interior of the thermal insulation package body (3) is provided with the inner lining (13); two sides of the top of the inner lining (13) are extendedly provided with a zipper tail strap (91), the periphery of the inner lining (13) is provided with the hooks and loops fasteners (14); the top edge of the thermal insulation package body (3) is provide with a zipper enclosure (8); two sides of the zipper enclosure (8) are provided with a side patch top (9), the zipper enclosure (8) is internally embedded with the iron wire frame (10); the iron wire frame (10) comprises a left iron wire frame (11) and a right iron wire frame (12); the front and rear sides of the thermal insulation package body (3) are provided with a side tab (6); the lower part of two groups of the side tab (6) is provided with a connection buckle (7), and the connection buckle (7) is buckled with two snaps (15); said two snaps (15) are fixedly connected through the strap (16).

2. The airtight thermal insulation package with a large opening therein according to claim 1, wherein the tableware box (2) is provided with two groups in total, both of which are movably arranged at the two inner sides of the base (1), and the base surface center of the tableware box (2) is provided with a handle.

3. The airtight thermal insulation package with a large opening therein according to claim 1, wherein the top of the outer pocket (4) is provided with a zipper.

4. The airtight thermal insulation package with a large opening therein according to claim 1, wherein the left iron wire frame (11) and the right iron wire frame (12) are symmetrically arranged inside the zipper enclosure (8).

5. The airtight thermal insulation package with a large opening therein according to claim 1, wherein the inner wall of the thermal insulation package body (3) is provided with a bonding belt stuck with the hooks and loops fasteners (14).

6. The airtight thermal insulation package with a large opening therein according to claim 1, wherein the thermal insulation package body (3) is a seamless airtight thermal insulation package made by hot pressing method with TPU material.

* * * * *